US011167398B2

(12) United States Patent
Chen

(10) Patent No.: US 11,167,398 B2
(45) Date of Patent: Nov. 9, 2021

(54) MAGNETIC TOOL CONNECTOR

(71) Applicant: JEI MOU INDUSTRIAL CO., LTD., Taichung (TW)

(72) Inventor: Po-Shen Chen, Taichung (TW)

(73) Assignee: JEI MOU INDUSTRIAL CO., LTD., Taichung (TW)

( * ) Notice: Subject to any disclaimer, the term of this patent is extended or adjusted under 35 U.S.C. 154(b) by 343 days.

(21) Appl. No.: 16/254,677

(22) Filed: Jan. 23, 2019

(65) Prior Publication Data

US 2019/0152030 A1 May 23, 2019

Related U.S. Application Data

(63) Continuation-in-part of application No. 15/661,038, filed on Jul. 27, 2017, now Pat. No. 10,603,769.

(30) Foreign Application Priority Data

Aug. 18, 2016 (TW) ..... 105126460

(51) Int. Cl.
*B25B 23/12* (2006.01)
*B25B 13/06* (2006.01)
*B25B 23/00* (2006.01)

(52) U.S. Cl.
CPC ..... *B25B 23/12* (2013.01); *B25B 13/06* (2013.01); *B25B 23/0035* (2013.01)

(58) Field of Classification Search
CPC ..... B25B 23/12; B25B 23/0035; B25B 13/06
See application file for complete search history.

(56) References Cited

U.S. PATENT DOCUMENTS 2,624,223 A * 1/1953 Clark ..... B25B 23/12 81/125
4,919,020 A * 4/1990 Huebschen ..... B25B 23/12 76/114
5,163,345 A 11/1992 Doan et al.
5,916,340 A * 6/1999 Forsyth ..... B25B 23/12 81/125
6,311,989 B1 11/2001 Rosanwo
6,973,858 B2 * 12/2005 Huang ..... B25B 15/001 279/82

(Continued)

FOREIGN PATENT DOCUMENTS

TW 397740 B 7/2000
TW 414133 U 12/2000

(Continued)

*Primary Examiner* — Hadi Shakeri
(74) *Attorney, Agent, or Firm* — Alan D. Kamrath; Karin L. Williams; Mayer & Williams PC

(57) ABSTRACT

A magnetic tool connector includes a main body having a working end. The working end defines first and second chambers in communication with each other. The first chamber is configured to receive an object to be driven. The second chamber having an opening at an end edge of the first chamber. The end edge of the first chamber defines an abutting surface for positioning the object within the first chamber. A magnetic assembly is slidably coupled to the main body and includes a magnet. The magnetic assembly is movable between a first position in which the magnet is located outside of the second chamber and a second position in which the magnet is located within the second chamber.

2 Claims, 10 Drawing Sheets

(56) References Cited

U.S. PATENT DOCUMENTS

| | | | | |
|---|---|---|---|---|
| 8,172,236 | B2 | 5/2012 | Shibata | |
| 8,479,616 | B2 | 7/2013 | Tsai | |
| 8,667,872 | B2 | 3/2014 | McCullough et al. | |
| 8,771,091 | B1 * | 7/2014 | Lin | B25B 23/0035 464/97 |
| 9,381,627 | B2 | 7/2016 | Chen | |
| 9,694,480 | B2 * | 7/2017 | Brown | B25B 13/06 |

FOREIGN PATENT DOCUMENTS

| | | | |
|---|---|---|---|
| TW | 551257 | U | 9/2003 |
| TW | M245010 | U | 10/2004 |
| TW | I264347 | B | 10/2006 |
| TW | M318490 | U | 9/2007 |
| TW | M342237 | U | 10/2008 |
| TW | M357342 | U | 5/2009 |
| TW | M362737 | U | 8/2009 |
| TW | M369224 | U | 11/2009 |
| TW | M396182 | U | 1/2011 |
| TW | M402173 | U | 4/2011 |
| TW | M429565 | U | 5/2012 |
| TW | I417172 | B | 12/2013 |
| TW | I444257 | B | 7/2014 |
| TW | I444258 | B | 7/2014 |
| TW | I455799 | B | 10/2014 |
| TW | I458597 | B | 11/2014 |
| TW | M508406 | U | 9/2015 |
| TW | I504487 | B | 10/2015 |
| TW | M518612 | U | 3/2016 |
| TW | M525819 | U | 7/2016 |

* cited by examiner

MAGNETIC TOOL CONNECTOR

CROSS-REFERENCE

The present application is a continuation-in-part application of U.S. patent application Ser. No. 15/661,038, filed on Jul. 27, 2017, now U.S. Pat. No. 10,603,769, of which the entire disclosure is incorporated herein.

FIELD OF THE INVENTION

The present invention relates to a tool connector and, particularly, to a tool connector configured to connect a tool by magnetic attraction.

BACKGROUND

TW Pat. No. 396182 shows a magnetic tool connector. The magnetic tool connector includes a body having a driven end at one end connectable to a driving tool and a working end connectable to a driven object at another end. The working end includes a magnet assembly configured to magnetically attract the driven object. The working end defines a hole. The magnet assembly includes an end in thread engagement with the hole. The magnet assembly includes a housing and a magnet disposed in the housing. The magnet is located outside of the hole.

When driving the driven object, the magnet is impacted by the driven object. The magnet is also subject to vibrational disturbance. Therefore, the magnet is easily damaged.

The present invention is, therefore, intended to obviate or at least alleviate the problems encountered in the prior art.

BRIEF SUMMARY

According to the present invention, a magnetic tool connector includes a main body having a first end and a second end and including a working end at the first end. The working end defines first and second chambers in communication with each other. The first chamber is configured to receive an object to be driven. The first chamber has a first opening at an end edge of the working end. The second chamber has a second opening at an end edge of the first chamber. The end edge of the first chamber defines an abutting surface for positioning the object within the first chamber. A magnetic assembly is slidably coupled to the main body and includes a magnet configured to magnetically attract the object. The magnetic assembly is movable between a first position in which the magnet is located outside of the second chamber and a second position in which the magnet is located within the second chamber and is prevented from being impacted and damaged by the object. The magnet includes an engaging side configured to abut and magnetically attract the object, and the engaging side is flush with the abutting surface when the magnetic assembly is in the second position.

In an example, the magnetic assembly includes a housing and the magnet is supported by the housing, and the housing is slidably coupled to the main body.

The main body includes a connecting structure and the housing is slidably connected to the connecting structure, and the connecting structure extends within the second chamber.

The connecting structure includes a first shoulder, a guide protrusion, and a second shoulder. The first and second shoulders extend at opposite ends of the guide protrusion.

The housing includes a flange at an end engaging the guide protrusion and movably restrained between the first and second shoulders.

The flange extends annularly and has a tab protruding radially inwardly. The tab has a top edge selectively abutting the first shoulder and a bottom edge selectively abutting the second shoulder.

When the magnetic assembly is in the second position, the top edge and the first shoulder are not abutted with one another, and the bottom edge and the second shoulder are abutted with one another.

When the magnetic assembly is in the second position, the top edge and the first shoulder are abutted with one another, and the bottom edge and the second shoulder are not abutted with one another.

The flange includes a first beveled surface extending between the top and bottom edges. The second shoulder includes a second beveled surface, and wherein the housing includes at least one groove extending through inner and outer peripheries thereof.

The second shoulder is disposed in a hole defined by the housing, and the magnet is disposed in the hole.

The main body includes a first structure in a form of a shaft and a second structure in a form of a socket. The shaft includes the guide protrusion and the first and second shoulders at a proximal end thereof and a driven end at a distal end thereof. The second structure defines the first and second chambers and includes a first open end defined by the first opening.

The second structure includes a second open end opposite the first open end and communicating with the second chamber.

The first chamber has a polygonal cross-section. The second chamber has a circular cross-section. A distance between two opposite sides of the first chamber is greater than a diameter of the second chamber.

In another example, the second chamber penetrates through the second end of the main body to form an assembling opening. The magnetic tool connector further includes a connecting member and an elastic member. The connecting member is fixedly coupled to the second chamber via the assembling opening and has a driven end and a supporting end. The elastic member is arranged between the magnetic assembly and the connecting member. Two opposite ends of the elastic member elastically abut against the magnetic assembly and the supporting end respectively.

The magnetic assembly includes a sliding member slidably disposed in the second chamber. The magnet is supported by one end of the sliding member, and the elastic member elastically abuts against the other end of the sliding member.

The second opening is formed as a circular hole with an inner diameter. The sliding member has a first section and a second section. The first and second sections have circular cross-sections. The first section has a first outer diameter, and the second section has a second outer diameter greater than the first outer diameter to form an abutting face between the first and second sections. The inner diameter is less than the second outer diameter but not less than the first outer diameter.

The main body has a shoulder formed between the first and second chambers and selectively abutted against the abutting face. The second opening penetrates through the shoulder.

The first chamber has a polygonal cross-section, and the second chamber has a circular cross-section. The connecting member has a connecting section formed between the driven end and the supporting end, and the connecting section has a polygonal cross-section and is fixedly coupled to the second chamber.

Other objectives, advantages, and new features of the present invention will become apparent from the following detailed description of the invention when considered in conjunction with the accompanied drawings.

DESCRIPTION OF THE DRAWINGS

The illustrative embodiments may best be described by reference to the accompanying drawings where.

Figure 1:
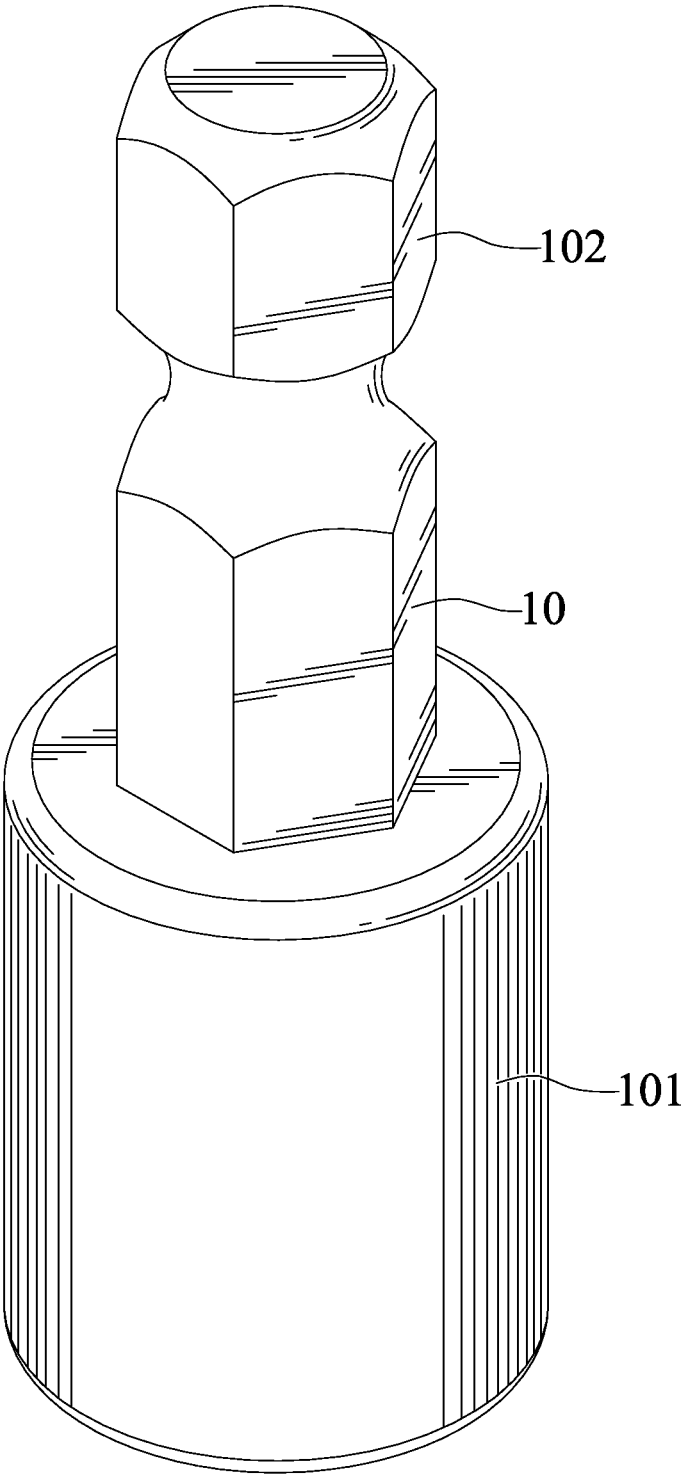
FIG. 1 is a perspective view of a magnetic tool connector of a first embodiment according to the present invention.
Figure 2:
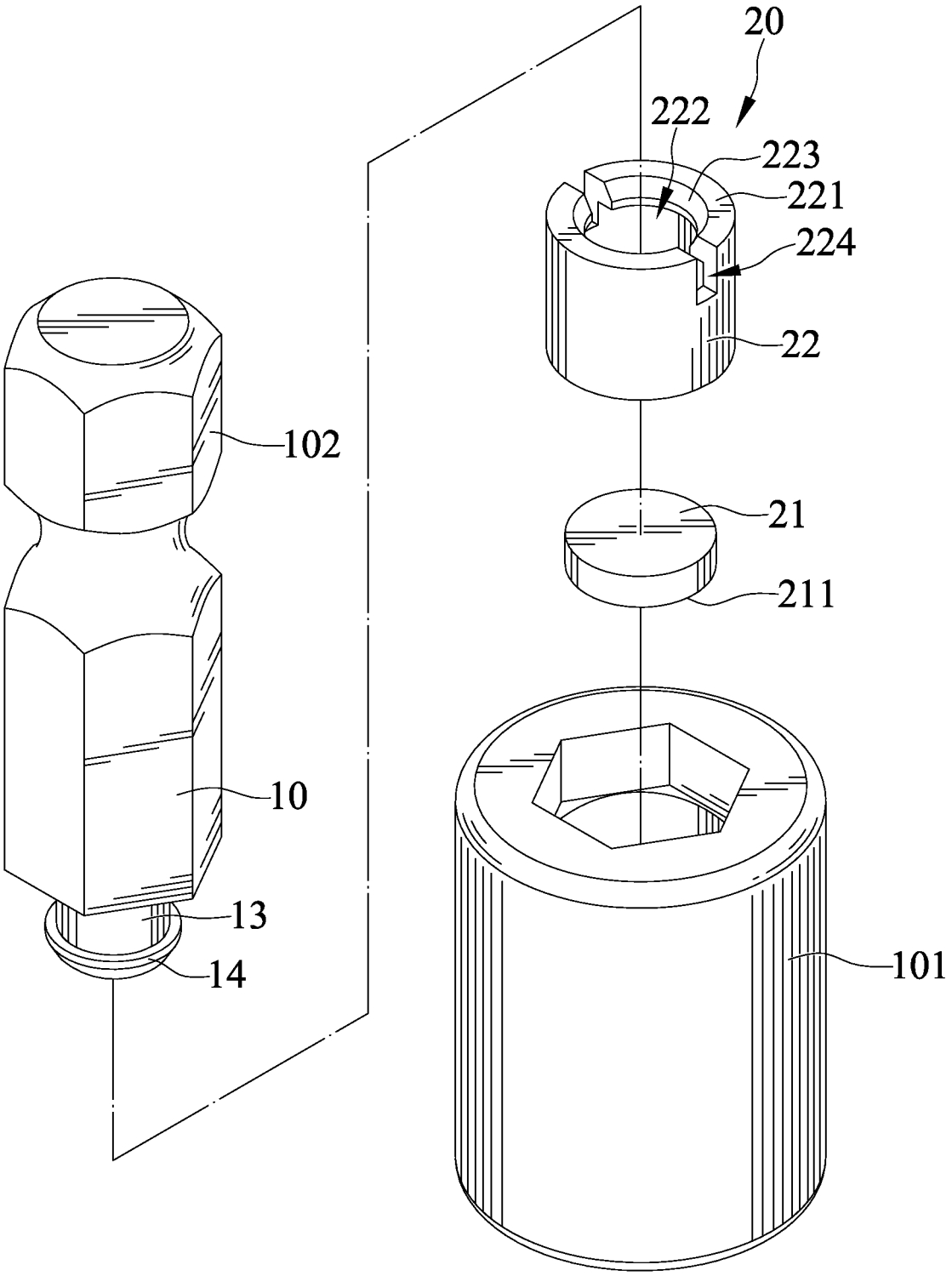
FIG. 2 is an exploded, perspective view of the magnetic tool connector of FIG. 1.
Figure 3:
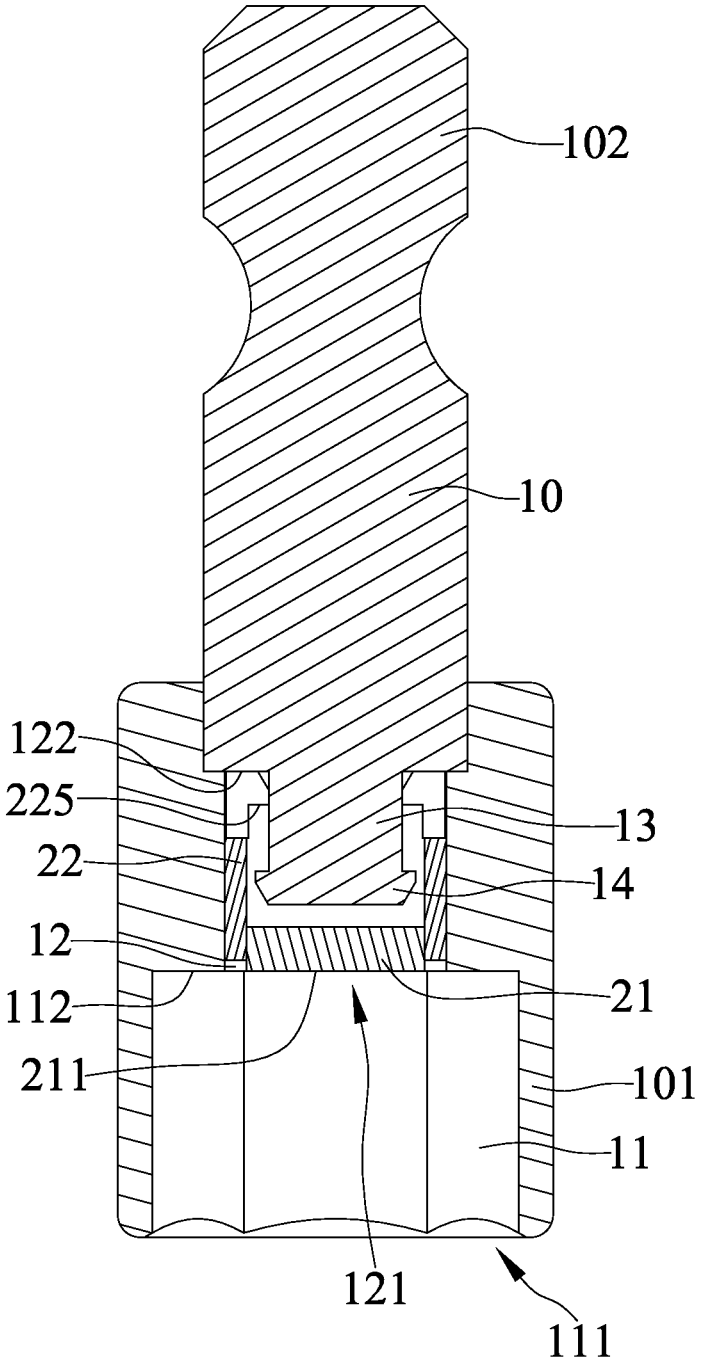
FIG. 3 is a cross-sectional view of the magnetic tool connector of FIG. 1.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "bottom", "side", "end", "portion", "section", "spacing", "length", "depth", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION

FIGS. 1-5 show a magnetic tool connector of a first embodiment according to the present invention. A main body 10 has a first end 101 and a second end 102 and includes a working end at the first end 101 and a driven end at the second end 102 respectively. The working end defines a first and second chamber 11 and 12. The first chamber 11 is configured to receive an object P to be driven. The first chamber 11 has a first opening 111 at an end edge of the working end. The second chamber 12 has a second opening 121 at an end edge of the first chamber 11. The end edge of the first chamber 11 defines an abutting surface 112 for positioning the object P within the first chamber 11. The first chamber 11 has a polygonal cross-section. The second chamber 12 has a circular cross-section. A distance between two opposite sides of the first chamber 11 is greater than a diameter of the second chamber 12. The first chamber 11 has a hexagonal cross-section. The housing 22 has a circular cross-section.

A magnetic assembly 20 is slidably coupled to the main body 10. The magnetic assembly 20 includes a magnet 21 configured to magnetically attract the object P and a housing 22 supporting the magnet 21. The main body 10 includes a connecting structure and the housing 22 is slidably connected to the connecting structure. The connecting structure extends within the second chamber 12. The connecting structure includes a first shoulder 122, a guide protrusion 13, and a second shoulder 14. The first and second shoulders 122 and 14 extend at opposite ends of the guide protrusion 13. The first and second shoulders 122 and 14 extend radially outwardly from the guide protrusion 13. The second shoulder 14 is disposed in a hole 222 defined by the housing 22. The second shoulder 14 inserts in the housing 22 through the hole 222. The magnet 21 is disposed in the hole 222. The housing 22 includes a flange 223 at an end engaging the guide protrusion 13 and movably restrained between the first and second shoulders 122 and 14. The flange 223 extends annularly and has a tab protruding radially inwardly.

The main body 10 includes a first structure in a form of a shaft and a second structure in a form of a socket. The shaft includes the guide protrusion 13 and the first and second shoulders 122 and 14 at a proximal end thereof and the driven end at a distal end thereof. The second structure defines the first and second chambers 11 and 12 and includes a first open end defined by the first opening 111. The second structure includes a second open end opposite the first open end and communicating with the second chamber 12. The guide protrusion 13 and the first and second shoulders 122 and 14 are inserted through the second open end into the second chamber 12. The shaft and the socket are not free to move with respect to each other. The shaft and socket are in tight engagement with one another.

The magnetic assembly 20 is movable between a first position in which the magnet 21 is located outside of the second chamber 12 and a second position in which the magnet 21 is located within the second chamber 12 and is prevented from being impacted and damaged by the object P. The magnet 21 includes an engaging side 211 configured to abut and magnetically attract the object P. The engaging side 211 is flush with the abutting surface 112 when the magnetic assembly 20 is in the second position. The engaging side 211 of the magnet 21 is not flush with the abutting surface 112 when the magnetic assembly 20 is in the first position. The engaging side 211 of the magnet 21 and the abutting surface 112 are aligned with an axis A when the magnetic assembly 20 is in the second position. Furthermore, the tab of the flange 223 has a top edge 221 selectively abutting the first shoulder 122 and a bottom edge 225 selectively abutting the second shoulder 14. When the magnetic assembly 20 is in the first position, the top edge 221 and the first shoulder 122 are not abutted with one another, and the bottom edge 225 and the second shoulder 14 are abutted with one another. When the magnetic assembly 20 is in the second position, the top edge 221 and the first shoulder 122 are abutted with one another, and the bottom edge 225 and the second shoulder 14 are not abutted with one another. In addition, the top edge 221 defines the top surface of the housing 22.

The flange 223 includes a first beveled surface extending between the top and bottom edges 221 and 225. The second shoulder 14 includes a second beveled surface. The housing 22 includes at least one groove 224 extending through inner and outer peripheries thereof. The at least one groove 224 extends radially from the hole 222. The first beveled surface facing inwardly. The second beveled surface facing outwardly. The at least one groove 224 facilitates deflection of the flange 223. The first and second beveled surfaces and the at least one groove 224 facilitate engagement of the housing 22 with the guide protrusion 13.

Figure 4:
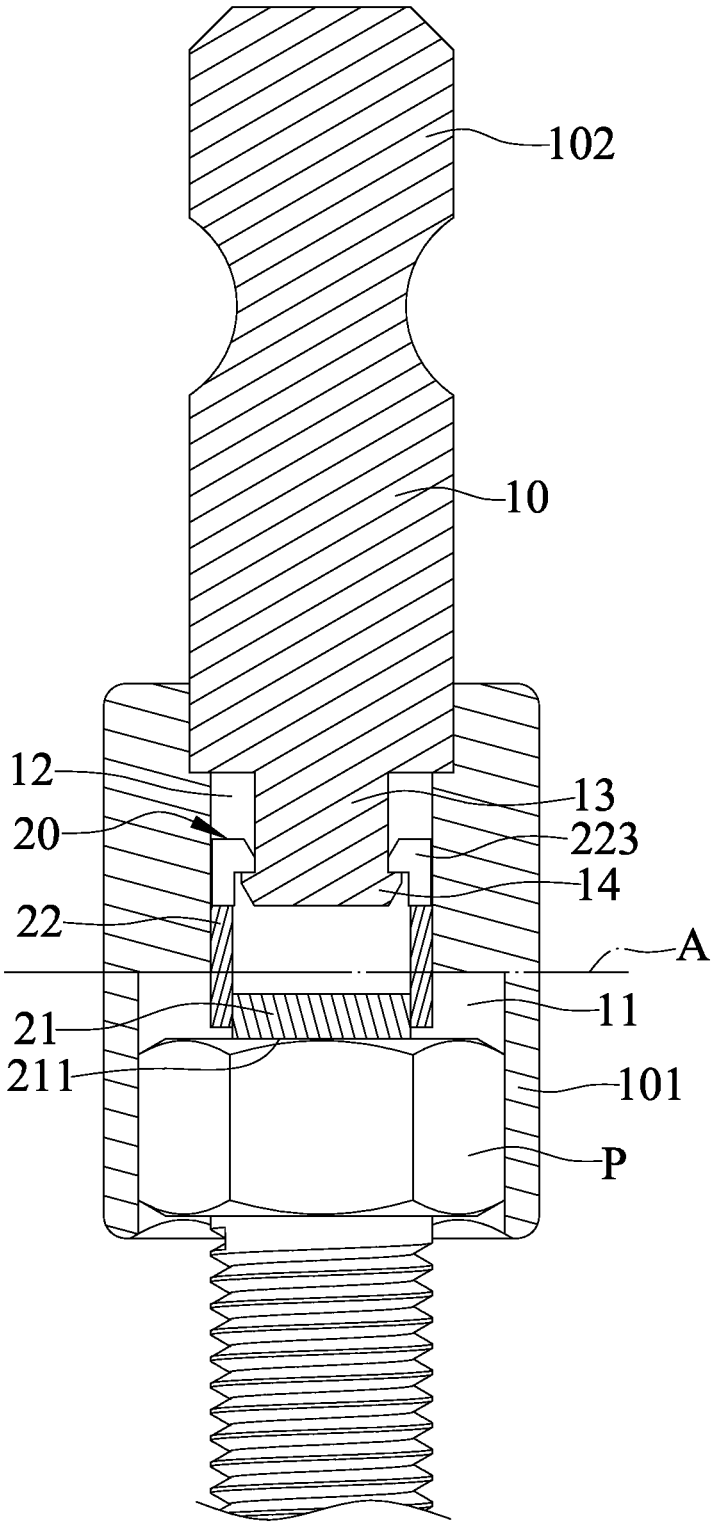
FIG. 4 is a cross-sectional view showing the magnetic tool connector of FIG. 1 receiving a driven object.
Figure 5:
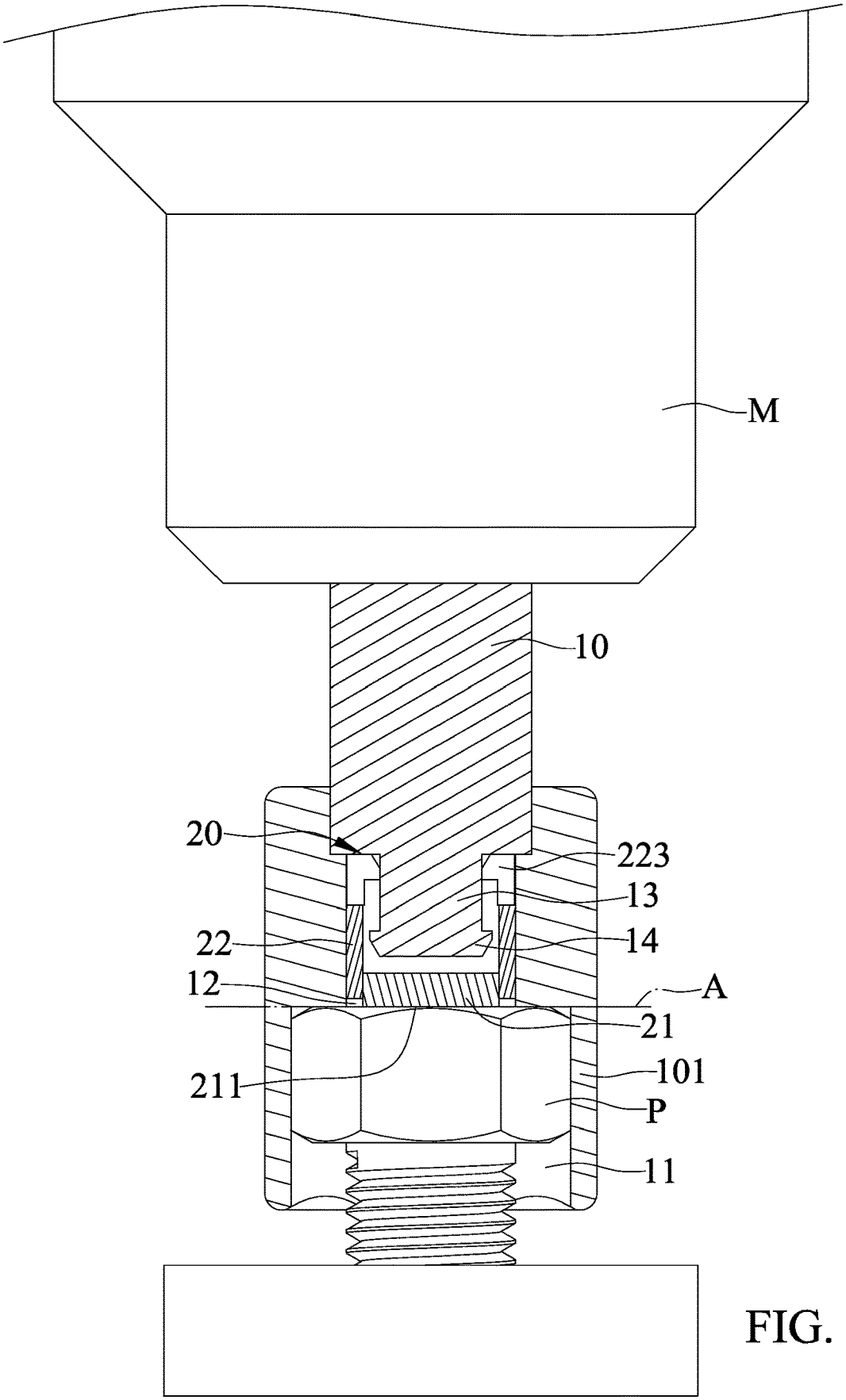
FIG. 5 is a cross-sectional view showing a driving tool driving the driven object through the magnetic tool connector of FIG. 1.
Figure 6:
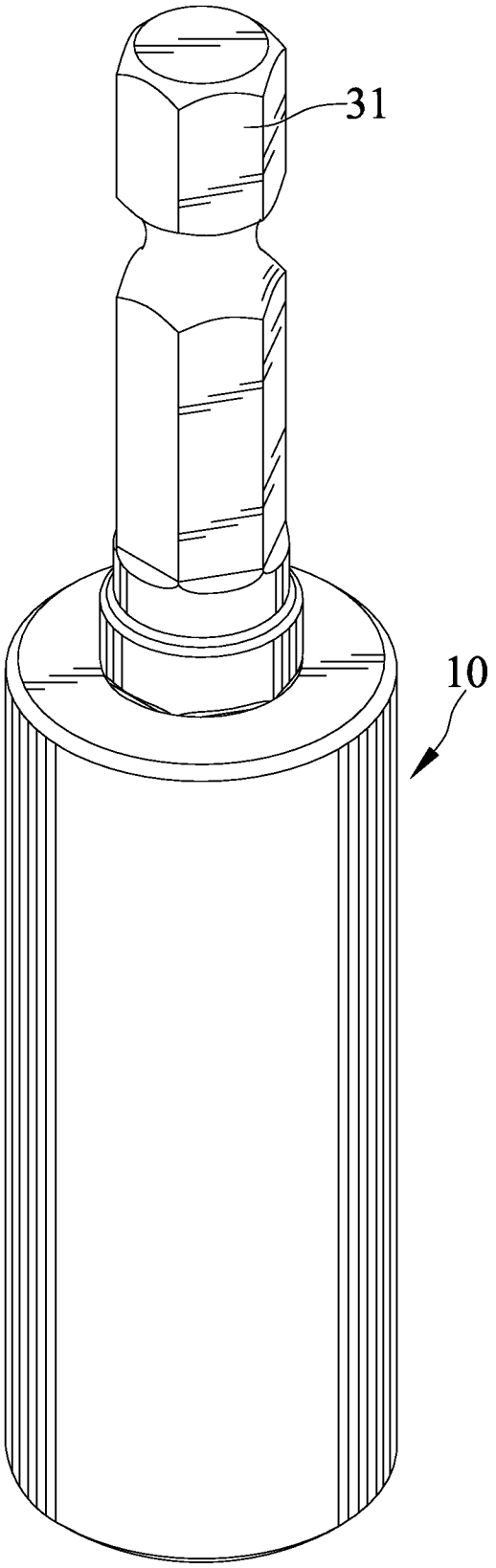
FIG. 6 is a perspective view of a magnetic tool connector of a second embodiment according to the present invention.
Figure 7:
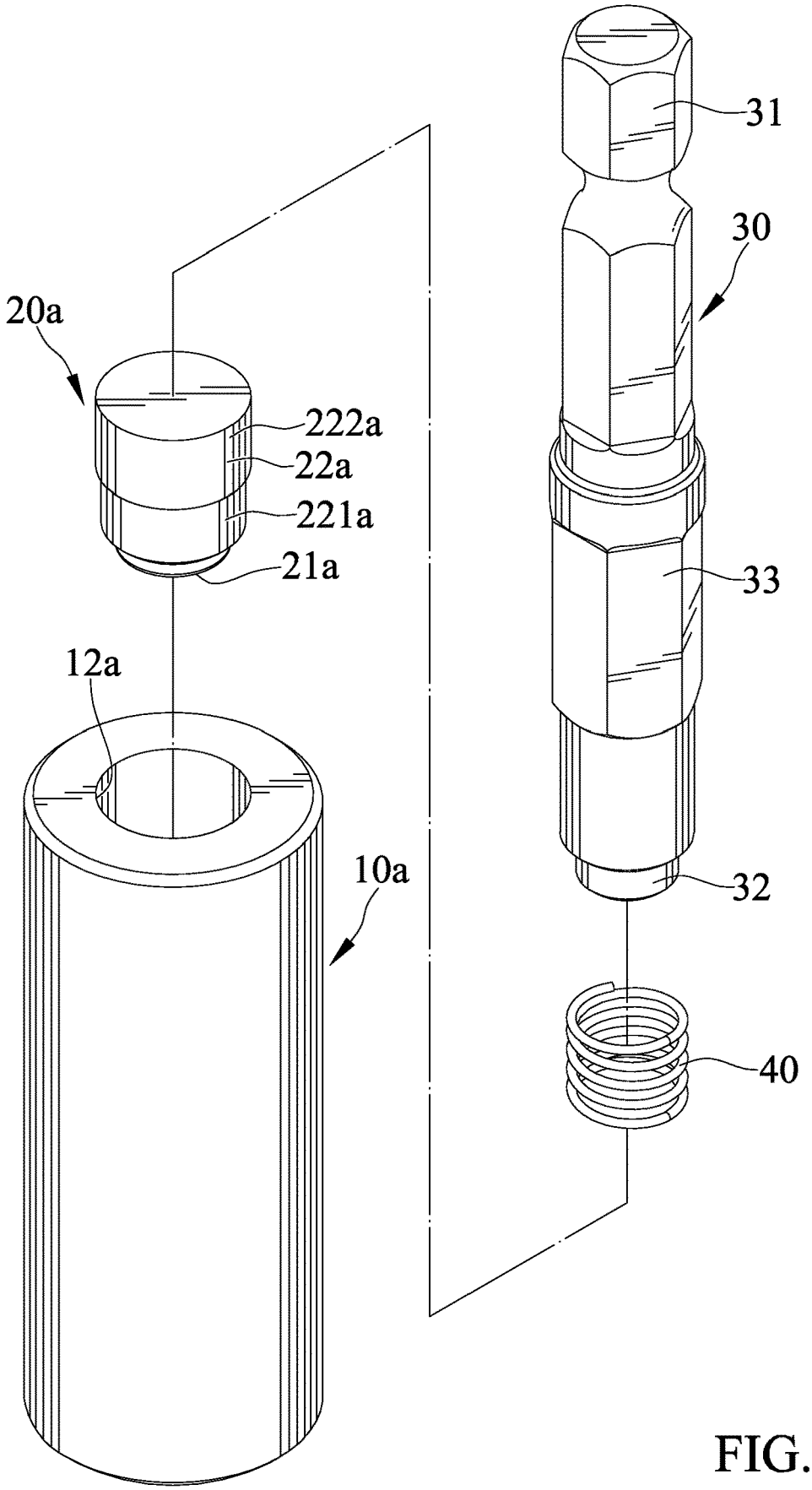
FIG. 7 is an exploded, perspective view of the magnetic tool connector of FIG. 6.
Figure 8:
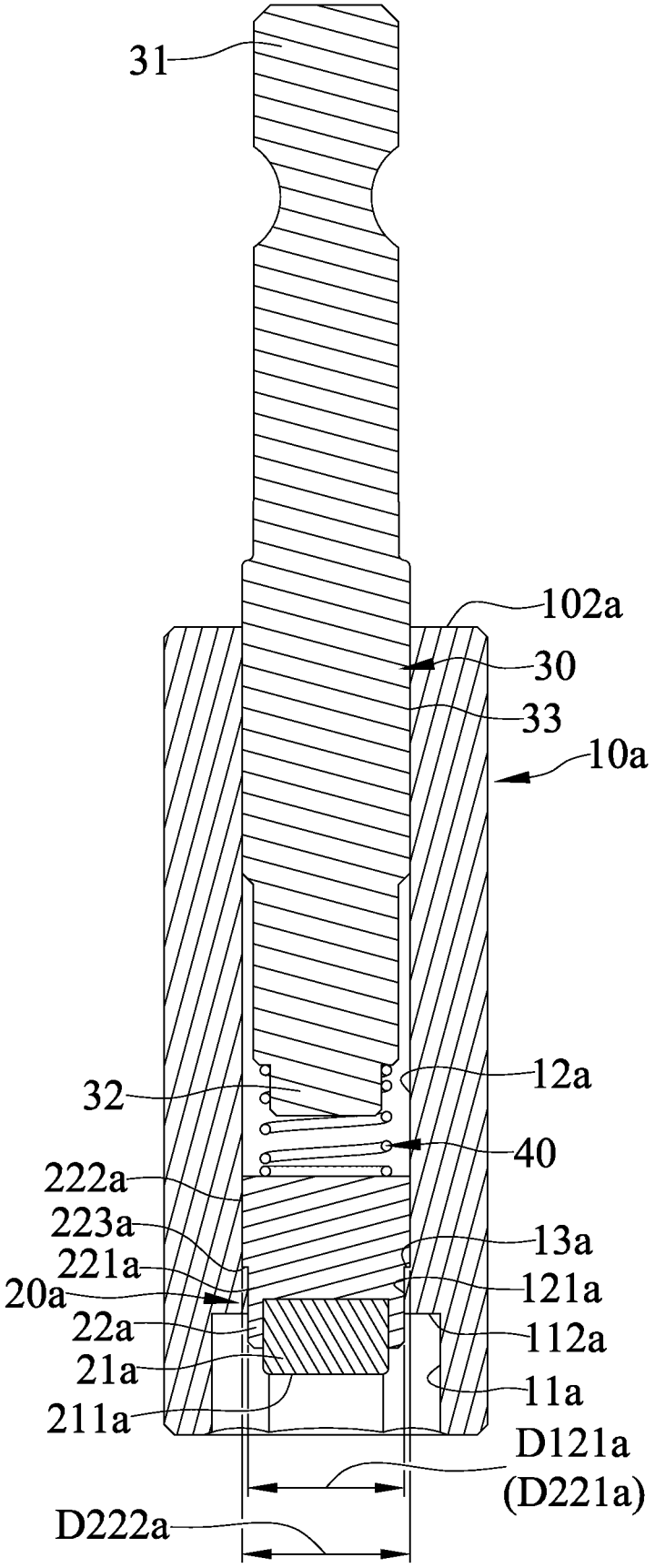
FIG. 8 is a cross-sectional view of the magnetic tool connector of FIG. 6.

FIG. 4 shows the object P to be driven is disposed in the first chamber 11, and the magnetic assembly 20 is in the first position. FIG. 5 shows a driving tool M can engage the driven end to drive the magnetic tool connector. When the object P is driven into another object, the object P is rest on the abutting surface 112, and the magnetic assembly 20 is moved to the second position.

In view of the forgoing, the magnet 21 is located within the second chamber 12 when the magnetic assembly 20 is in the second position, the engaging side 211 of the magnet 21 and the abutting surface 112 are flush with one another and are aligned with the axis A, and the abutting surface 112 prevents the object P from impacting the magnet 21. Therefore, the magnet 21 is not impacted and damaged by the object P.

FIGS. 6-10 show a magnetic tool connector of a second embodiment according to the present invention. The second embodiment is substantially the same as the first embodiment except that the second chamber 12*a* penetrates through the second end 102*a* of the main body 10*a* to form an assembling opening at the second end 102*a*. The magnetic tool connector of the second embodiment further includes a connecting member 30 and an elastic member 40.

The connecting member 30 is fixedly coupled to the second chamber 12*a* via the assembling opening and has a driven end 31 and a supporting end 32. Further, the first chamber 11*a* has a polygonal cross-section, and the second chamber 12*a* has a circular cross-section. The connecting member 30 has a connecting section 33 formed between the driven end 31 and the supporting end 32. The connecting section 33 has a polygonal cross-section and is fixedly coupled to the second chamber 12*a*, so as to allow the connecting member 30 and the elastic member 40 to be assembled sequentially with respect to the second chamber 12*a*. Thus, the magnetic tool connector of the second embodiment can easily be assembled.

The elastic member 40 is arranged between the magnetic assembly 20*a* and the connecting member 30. Two opposite ends of the elastic member 40 elastically abut against the magnetic assembly 20*a* and the supporting end 32, respectively.

The magnetic assembly 20*a* includes a sliding member 22*a* slidably disposed in the second chamber 12*a*. The magnet 21*a* is supported by one end of the sliding member 22*a*, and the elastic member 40 elastically abuts against the other end of the sliding member 22*a*. Thus, the elastic member 40 may be a compression spring for biasing the sliding member 22*a*.

The second opening 121*a* is formed as a circular hole with an inner diameter D121*a*. The sliding member 22*a* has a first section 221*a* and a second section 222*a* integrally formed therein. Both of the first and second sections 221*a* and 222*a* have circular cross-sections. Further, the first section 221*a* has a first outer diameter D221*a*, and the second section 222*a* has a second outer diameter D222*a* greater than the first outer diameter D221*a* to form an abutting face 223*a* between the first and second sections 221*a* and 222*a*. The inner diameter D121*a* is less than the second outer diameter D222*a* but not less than the first outer diameter D221*a* to prevent the sliding member 22*a* falls out of the second chamber 12*a*.

The main body 10*a* has a shoulder 13*a* formed between the first and second chambers 11*a* and 12*a* and selectively abutted against the abutting face 223*a* to limit the sliding member 22*a*. The second opening 121*a* penetrates through the shoulder 13*a* to cause the first and second chambers 11*a* and 12*a* in communication with each other.

Figure 9:
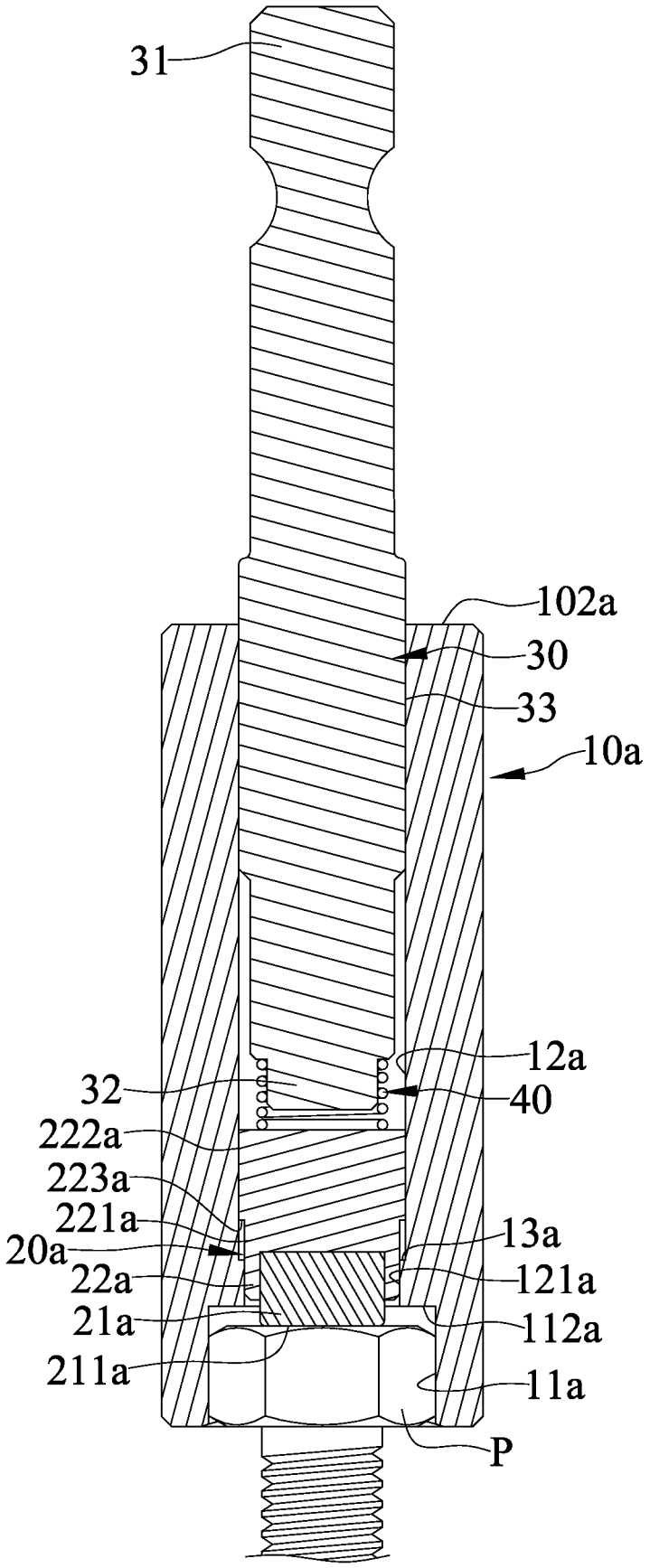
FIG. 9 is a cross-sectional view showing the magnetic tool connector of FIG. 6 receiving a driven object.
Figure 10:
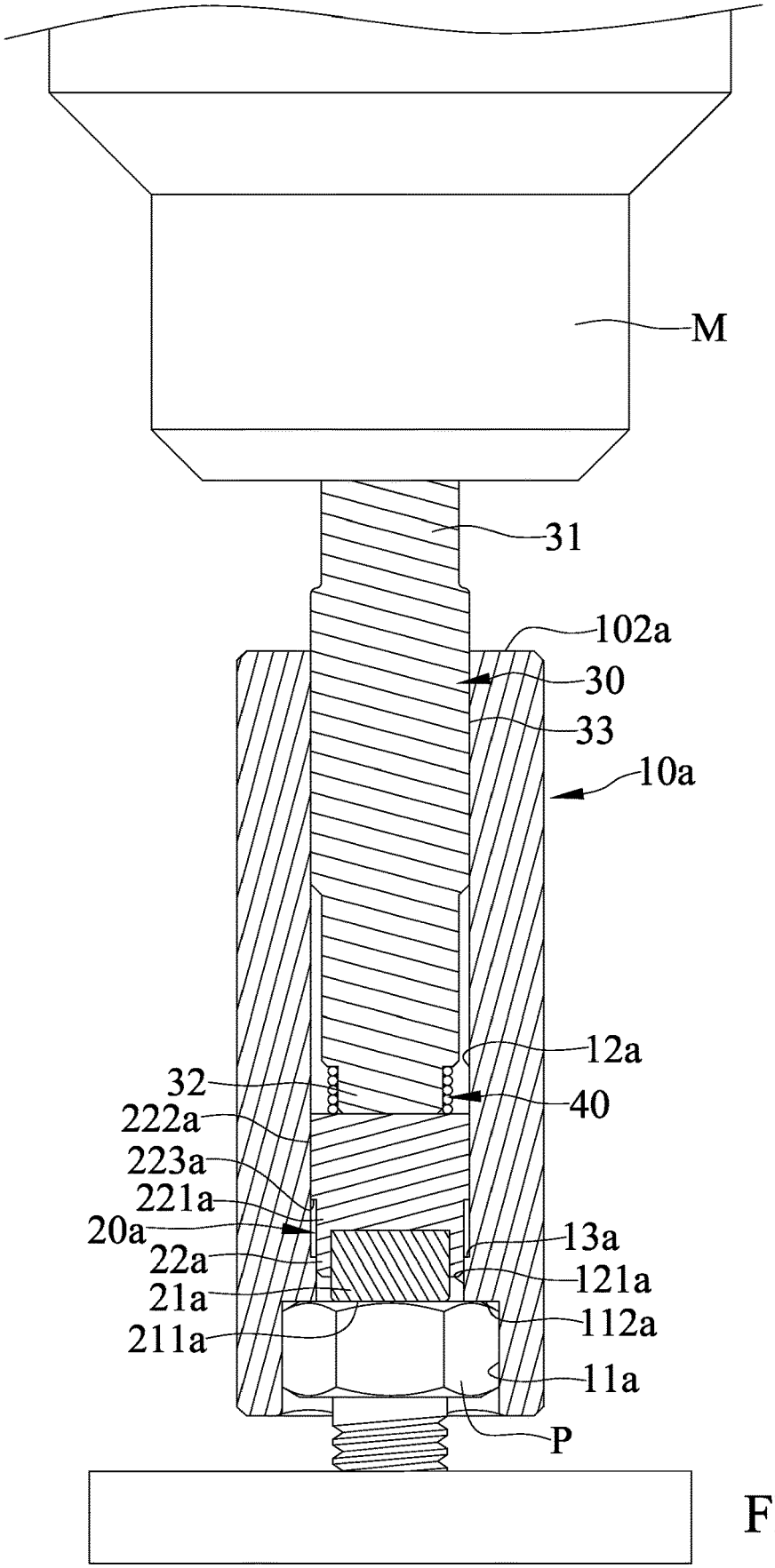
FIG. 10 is a cross-sectional view showing a driving tool driving the driven object through the magnetic tool connector of FIG. 6.

FIG. 9 shows the object P to be driven is disposed in the first chamber 11*a*, and the magnetic assembly 20*a* is in the first position. FIG. 10 shows a driving tool M can engage the driven end 31 to drive the magnetic tool connector. When the object P is driven into another object, the object P is rest on the abutting surface 112*a*, and the magnetic assembly 20*a* is moved to the second position.

In view of the forgoing, the magnet 21*a* is located within the second chamber 12*a* when the magnetic assembly 20*a* is in the second position, the engaging side 211*a* of the magnet 21*a* and the abutting surface 112*a* are flush with one another and are aligned with the axis, and the abutting surface 112*a* prevents the object P from impacting the magnet 21*a*. Therefore, the magnet 21*a* is not impacted and damaged by the object P.

The foregoing is merely illustrative of the principles of this invention, and various modifications can be made by those skilled in the art without departing from the scope and spirit of the invention.

The invention claimed is:

1. A magnetic tool connector comprising:

a main body having a first end and a second end and including a working end at the first end, wherein the working end defines first and second chambers in communication with each other, wherein the first chamber is configured to receive an object to be driven, wherein the first chamber has a first opening at an end edge of the working end, wherein the second chamber has a second opening at an end edge of the first chamber, wherein the end edge of the first chamber defines an abutting surface for positioning the object within the first chamber, wherein the second chamber penetrates through the second end of the main body to form an assembling opening, wherein the second opening is formed as a circular hole with an inner diameter;

a magnetic assembly slidably coupled to the main body and including a magnet configured to magnetically attract the object, and a sliding member slidably disposed in the second chamber, wherein the magnetic assembly is movable between a first position in which the magnet is located outside of the second chamber and a second position in which the magnet is located within the second chamber and is prevented from being impacted and damaged by the object, wherein the magnet is supported by a first end of the sliding member and includes an engaging side configured to abut and magnetically attract the object, wherein the engaging side is flush with the abutting surface when the magnetic assembly is in the second position, wherein the sliding member has a first section and a second section, wherein the first and second sections have circular cross-sections, wherein the first section has a first outer diameter, wherein the second section has a second outer diameter greater than the first outer diameter to form an abutting face between the first and second sections, wherein the inner diameter is less than the second outer diameter but not less than the first outer diameter, wherein the main body has a shoulder formed between the first and second chambers and selectively abutted against the abutting face, and wherein the second opening penetrates through the shoulder;

a connecting member fixedly coupled to the second chamber via the assembling opening and having a driven end exposed out the second end of the main body and a supporting end disposed in the second chamber; and an elastic member arranged between the magnetic assembly and the connecting member, wherein two opposite ends of the elastic member respectively elastically abut against a second end of the sliding member and the supporting end, wherein the elastic member is a compression spring with a number of loops, and wherein the number of loops is abutted against each other to a full compressed state of the compression spring when the magnetic assembly is in the second position.

2. The magnetic tool connector as claimed in claim 1, wherein the first chamber has a polygonal cross-section, wherein the second chamber has a circular cross-section, wherein the connecting member has a connecting section formed between the driven end and the supporting end, and wherein the connecting section has a polygonal cross-section and is fixedly coupled to the second chamber.

* * * * *